US006336415B1

(12) United States Patent
Rüegg et al.

(10) Patent No.: US 6,336,415 B1
(45) Date of Patent: Jan. 8, 2002

(54) METHOD FOR THE HEAT TREATMENT OF SOLIDS

(75) Inventors: Hans Rüegg, Wohlen; Beat Stoffel, Holderbank, both of (CH)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 09/700,163

(22) PCT Filed: May 10, 1999

(86) PCT No.: PCT/CH99/00192

§ 371 Date: Jan. 22, 2001

§ 102(e) Date: Jan. 22, 2001

(87) PCT Pub. No.: WO99/58902

PCT Pub. Date: Nov. 18, 1999

(30) Foreign Application Priority Data

May 11, 1998 (EP) ..... 98810424
Jun. 22, 1998 (EP) ..... 98810570

(51) Int. Cl.[7] ..... F23J 11/00; F23J 15/00; F23B 5/00; F23B 1/12

(52) U.S. Cl. ..... 110/342; 110/345; 110/346; 110/203; 110/210; 110/229; 110/243; 110/295; 48/198.6

(58) Field of Search ..... 110/203, 204, 110/205, 208, 209, 210, 211, 212, 214, 229, 231, 243, 244, 245, 295, 342, 345, 346; 422/139, 140, 184.1; 48/198.6

(56) References Cited

U.S. PATENT DOCUMENTS 3,658,482 A * 4/1972 Evans et al. ..... 23/277 C
3,664,277 A * 5/1972 Chatterjee et al. ..... 110/8 A
4,334,484 A * 6/1982 Payne et al. ..... 110/210
4,427,362 A * 1/1984 Dykema ..... 431/4
4,579,070 A 4/1986 Lin et al.
4,699,071 A * 10/1987 Vier et al. ..... 110/345
5,040,470 A * 8/1991 Lofton et al. ..... 110/234
5,044,287 A * 9/1991 Furukawa et al. ..... 110/346
5,501,162 A * 3/1996 Kravets ..... 110/347
5,967,061 A * 10/1999 Ashworth et al. ..... 110/203

FOREIGN PATENT DOCUMENTS

| | | |
|---|---|---|
| DE | 31 25 429 | 2/1983 |
| DE | 44 26 357 | 2/1995 |
| DE | 44 01 821 | 7/1995 |
| DE | 196 13 777 | 10/1997 |
| EP | 0 413 104 | 2/1991 |
| EP | 0 487 052 | 5/1992 |

* cited by examiner

*Primary Examiner*—Denise L. Esquivel
*Assistant Examiner*—K. B. Rinehart
(74) *Attorney, Agent, or Firm*—Burns, Doane, Swecker & Mathis, L.L.P.

(57) ABSTRACT

In a process for the thermal treatment of solid materials (3), in particular refuse, in which the solid materials (3) are burnt/gasified or pyrolized in a first step (5) with a lack of oxygen, and then, in an afterburning zone (14), the flue gases (6) from the first step (5) are mixed with an oxygen-containing gaseous medium (15) and are burnt with complete burn-off, the flue gases (6) emerging from the first step (5) are firstly actively homogenized in a mixing zone (7) with the addition of a gaseous oxygen-free or low-oxygen medium (8) before they are mixed with the oxygen-containing medium (15). Then, the homogenized flue-gas stream flows through a holding zone (13), in which it stays for at least 0.5 second, before, in an afterburning zone (14), the medium (15) which serves to ensure complete burn-off of the flue gas is added. The process according to the invention is distinguished by simple process steps and by a reduced level of pollutant emissions, in particular NOx, compared to the prior art.

17 Claims, 5 Drawing Sheets

METHOD FOR THE HEAT TREATMENT OF SOLIDS

BACKGROUND OF THE INVENTION

1. Field of the Invention

The invention relates to a process for the thermal treatment of solid materials, in particular refuse, such as domestic and community waste, in which the solid materials are burnt/gasified or pyrolized in a first step with a lack of oxygen, and then, in an afterburning zone, the flue gases from the first step are mixed with an oxygen-containing gaseous medium and are burnt with complete burn-off.

2. Background of the Invention

It is known in the prior art to burn lumpy solid materials, such as for example refuse, in a combustion chamber to which primary air is added, and a downstream afterburning chamber, to which secondary air is added. Usually, in this case, the solid material is moved on a combustion grate. The primary air is fed in beneath the grate and flown through openings in the grate covering into the bed of solid material lying above the grate.

The flue gases which are formed in and above the bed during combustion have a composition and temperature which fluctuate considerably locally and over the course of time. Therefore, in conventional systems, these flue gases are subsequently mixed with the aid of secondary air or secondary air and recirculated flue gas. The secondary air fulfills the following functions:

mixing the gases emerging from the combustion chamber supplying oxygen in order to ensure burn-off of the gases cooling of the emerging gases.

The primary air added in the first step is usually sufficient to completely burn the fuel, and the secondary air is used to achieve cross-mixing of the flue gas (mixing of CO-containing gas trains with $O_2$-containing gas trains). To ensure sufficient mixing, the amount of secondary air blown in must be selected to be suitably high. However, this excess air has the drawback of increasing the volume of flue gas.

In order to eliminate this drawback, EP 0,607,210 B1 describes a process for the combustion of solid materials, in which apart from the primary air no further combustion air is fed into the combustion boiler. To improve the poor burn-off of the gases which is caused by insufficient mixing in the afterburning chamber and which leads to high pollutant levels in the flue gas, it is proposed in EP 0,607,210 B1, on the one hand to add sufficient primary air to provide an excess of oxygen as early as in the first step, and on the other hand to inject water steam into the combustion boiler above the combustion space and in the lower area of the afterburning chamber at an ultrasonic speed produced by excess pressure. This process has the drawback that, in the event of there being an excess of air in the first combustion step, much of the nitrogen contained in the fuel is oxidized to form NO, and consequently it is impossible to achieve low NOx emissions.

A further process for the thermal treatment of refuse is known (Beckmann, M. and R. Scholz: "Vergasung von Abfällen" [Gasification of Refuse] in "Vergasungsverfahren für die Entsorgung von Abfällen" [Gasification Process for Disposing of Refuse], Springer-VDI-Verlag GmbH, Düsseldorf, 1998, pp. 80–109), in which process the volume of primary air beneath the grate is reduced to such an extent that the fuel is gasified and a CO-rich flue gas is formed. In a following, completely separate afterburning chamber, this flue gas is afterburnt with air. Although the considerable reduction in the addition of air in the first step is reported to provide an advantageous clear reduction in the NOx emissions compared to conventional grate combustion systems, hitherto this process has only been carried out on trial scale. The afterburning chamber was completely separate from the combustion chamber and connected by a pipe. The flue-gas stream was homogenized by means of turbulence when it flowed through this pipe. As a result of the small batch size and of the flue-gas stream being guided out of the primary combustion chamber through a connection pipe, it was possible to dispense with a device for mixing the flue-gas stream emanating from the primary combustion chamber without increased concentrations of pollutants being found in the flue gas from the afterburning chamber. However, the use of a pipe to connect the primary combustion chamber with the afterburning chamber represents a drawback in an industrial-scale installation (wear, caking).

SUMMARY OF THE INVENTION

The invention seeks to avoid these drawbacks. Accordingly, one object of the invention is to provide a novel process for the thermal treatment of solid materials, in particular refuse, in which the solid materials are burnt/gasified or pyrolized in a first step with a lack of oxygen, and then the emerging gases are mixed with the oxygen-containing medium which is required for complete burn-off and are burnt, in which process local concentration and temperature fluctuations in the flue gas from the first step are eliminated and as a result the pollutant concentrations, in particular the NOx emissions, are minimized.

According to the invention, this is achieved by the fact that, for the purpose of NOx reduction, the flue gases emerging from the first step, before they are mixed with the oxygen-containing medium in a mixing zone, are actively homogenized with the addition of a gaseous, oxygen-free or low-oxygen medium, and the homogenized, low-oxygen flue-gas stream emerging from the mixing zone, before the oxygen-containing medium which is required for complete burn-off is added, passes through a holding zone, the residence time in the holding zone being at least 0.5 second.

The advantages of the invention consist in the fact that the gases emerging from the first step, due to their subsequent homogenization, no longer exhibit any concentration and temperature fluctuations when they are mixed with the burn-off air. The additional residence time for the homogenized gas stream in the holding zone with a lack of air (substoichiometric air ratio) allows the NO which has already been formed to be reduced by the $NH_x$, HCN and CO present to form $N_2$. Consequently, only minimal pollutant emissions are formed in the thermal treatment according to the invention of the solid materials.

It is particularly expedient if recirculated flue gas, water steam, oxygen-depleted air or inert gases, such as for example nitrogen, are used as gaseous oxygen-free or low-oxygen media for homogenization. These gases are advantageously injected into the mixing zone perpendicular to the direction of flow of the flue gases or, in order to improve the homogenization and mixing effect still further, are injected at a certain angle and in the opposite or same direction to the direction of flow of the flue gas from the first step.

Furthermore, it is advantageous if the active homogenization of the flue gases emerging from the first step is carried out with the aid of components (static mixing elements) which are installed in the mixing zone. These installed components divert the flow of the flue gases and consequently cause them to be efficiently and intimately mixed. It is expedient if these installed components have cavities through which a cooling medium, e.g. water, water steam or air, flows.

Finally, it is advantageous for the active homogenization of the flue gases emerging from the first step to be carried out by means of constrictions or widenings of the cross section of the flow channel.

Moreover, it is expedient to control the temperature of the flue gases in the area where the oxygen-containing medium is injected by means of the amount of oxygen-free or low-oxygen gaseous medium which is fed to the mixing zone. This represents a very simple way of keeping the temperature constant.

It is advantageous if a grate system with center-current firing or with countercurrent firing is used as the first step.

Furthermore, it is advantageous if a fluidized bed is used as the first step, since this provides a very good mass and heat transfer effect. Local temperature peaks and locally increased wear to the refractory lining can be prevented. Moreover, the ferrous and nonferrous metals contained in the waste can be recovered from the ash with a very good quality.

It is also expedient if the afterburning zone is a fluidized bed and the oxygen-containing gaseous medium is fed to the entry to the fluidized bed or directly into the fluidized bed. It is then advantageously possible, due to the increased heat transfer caused by the presence of particles, to avoid local hot zones with a high level of thermal NOx formation. Moreover, caking on the heat-exchanger walls is prevented, with the result that the corrosion on the heat-exchanger surfaces is reduced. It is possible to set higher steam pressures and temperatures, allowing a higher thermal efficiency of the combustion installation to be achieved.

Finally, it is expedient if the holding zone is a fluidized bed and the gaseous oxygen-free or low-oxygen medium is fed to the entry to the fluidized bed or directly into the fluidized bed.

BRIEF DESCRIPTION OF THE DRAWINGS

Preferred embodiments of the invention are disclosed in the following description and illustrated in the accompanying drawings, in which.

Only those parts which are essential to gain an understanding of the invention are shown. The direction of flow of the media is indicated by arrows.

DESCRIPTION OF THE PREFERRED EMBODIMENTS

Figure 1:
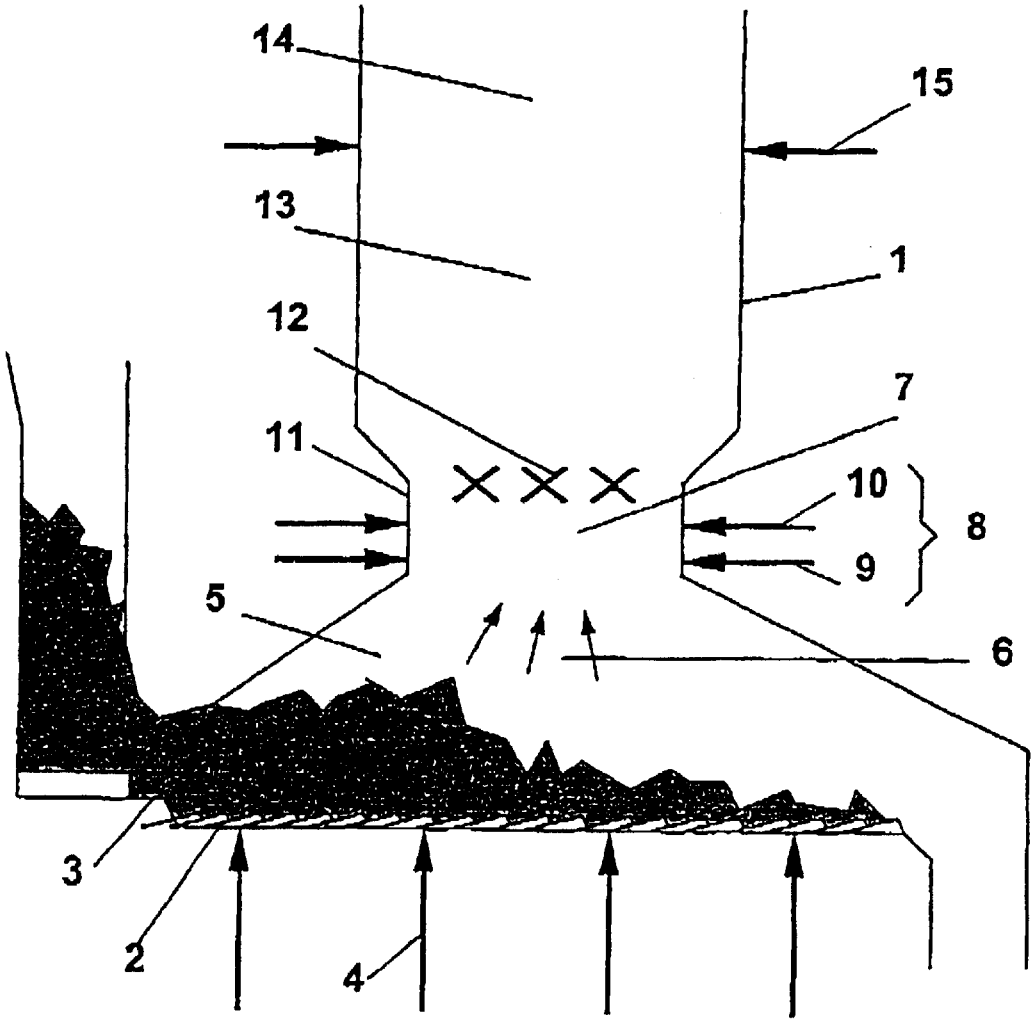
FIG. 1: shows a partial longitudinal section through an installation for the thermal treatment of waste, in a first variant embodiment of the invention in which a combustion grate is used an the first step.

Referring now to the drawings, wherein like reference numerals designate identical or corresponding parts throughout the several views, FIG. 1 diagrammatically shows part of an installation for the thermal treatment of solid materials, e.g. waste or coal, in a first variant embodiment of the invention. Waste is to be used in the present exemplary embodiment.

A grate 2 is arranged in the bottom part of a boiler 1, of which only the first flue is shown and the further radiation flues and the convection part of which are not shown in FIG. 1. The waste-incineration plant shown is designed with a center-current grate firing, i.e. the afterburning chamber 14 is arranged in the center above the grate 2.

The solid materials 3, in this case waste, are introduced into the boiler 1 and come to lie on the grate 2. Primary air 4 is blown in from below through the grate 2. Since only a small quantity of primary air 4 is supplied, the lack of air or oxygen means that only a partial combustion or a gasification of the waste takes place in this first process step 5. CO-containing and low-$O_2$ flue gases 6 are formed in this first step 5 and then flow into a mixing zone 7. The flue gas 6 emerging from the first step 5 is homogenized in this mixing zone 7.

In order to achieve homogenization, at least one virtually oxygen-free or low-oxygen gaseous medium 8 is added in the mixing zone 7. In the present exemplary embodiment, on the one hand water steam 9 and on the other hand recirculated flue gas 10 are added as the medium 8. Nitrogen or other inert gases, and also air with a reduced oxygen content, are likewise suitable for homogenization of the flue gas 6 from the first step 5. In this case, it is sufficient if one of these media 8 is introduced into the mixing zone 7, but mixtures of these different media 8 are, of course, also suitable. As shown in FIG. 1, in this exemplary embodiment the gaseous medium 8 is injected into the mixing zone 7 approximately perpendicular to the direction of flow of the flue gases 6.

Even more intensive mixing and homogenization is achieved if the medium 8 is added at an angle in the opposite direction to the direction of flow of the flue gases 6 from the first process step 5. It is also possible to add the medium 8 at an angle in the same direction as the direction of flow of the flue gases 6 from the first process step 5. A high elevated pressure of the medium 8 also improves the homogenization effect.

In the present example, the mixing zone 7 is notable for variations in the cross-sectional area of the walls of the boiler 1, i.e. for variations 11 in the cross-sectional area of the flow channel. These variations in cross section may be either constrictions or widenings of the flow channel. The variations 11 in cross section assist with homogenization of the flue gases.

Furthermore, in the present exemplary embodiment in accordance with FIG. 1, additional installed components 12 (static mixing elements) are arranged in the mixing zone 7, which components ensure that the flow of the flue gases 6 is diverted and therefore ensure further mixing and active homogenization of the flue gases 6. The static mixing elements 12 have cavities (not shown in the figure) through which coolant, e.g. air, water or water steam, flows.

Naturally, in other exemplary embodiments the various technical means mentioned above (addition of a gaseous, virtually oxygen-free medium, installed components in the gas flow, variations in the cross-sectional area of the flow channel) may in each case be used as alternatives for homogenization of the flue gases 6 from the first step 5.

The homogenized CO-rich flue gas emerging from the mixing zone 7 then passes into a holding zone 13, in which there is also a lack of oxygen, i.e. a substoichiometric air ratio in present. In the holding zone 13, some of the NO which has already been formed from the combustion is reduced in the presence of CO, $NR_1$ and HCN to form $N_2$. It is of primary importance for the invention that the residence time of the homogenized flue gases in the holding zone 13 be at least 0.5 second. Given a standard flue-gas speed of approximately 4 m/s, this means that the holding zone must be at least approximately 2 m long.

Then, the flue gas flows out of the holding zone into the afterburning zone 14. There, an oxygen-containing medium 15, for example air (secondary air), is added, in order to ensure complete burn-off of the flue gas.

The novel process for the zoned thermal treatment of solid materials is distinguished by simple process steps and by a reduced level of NOx emissions compared to the known prior art. In this case, in contrast to the known prior art, the gas 6 emerging from the first step 5 is mixed and homogenized not in the afterburning zone by means of secondary air, but rather in an additional mixing zone 7 before the actual afterburning, a holding zone 13 for the flue gas, with a lack of oxygen, being incorporated between the mixing of the flue gases 6 and the supply of the burn-off air 15, in which holding zone the gases have to stay for at least 0.5 second. In this way, it is possible both to reduce pollutant emission levels and to achieve complete burn-off.

Furthermore, it is very simple, using the process according to the invention, to control the temperature of the flue gases in the area where the oxygen-containing medium 15 is injected, by simply varying the amount of medium 8 fed into the mixing zone 7 and adapting the prevailing operating conditions.

Figure 2:
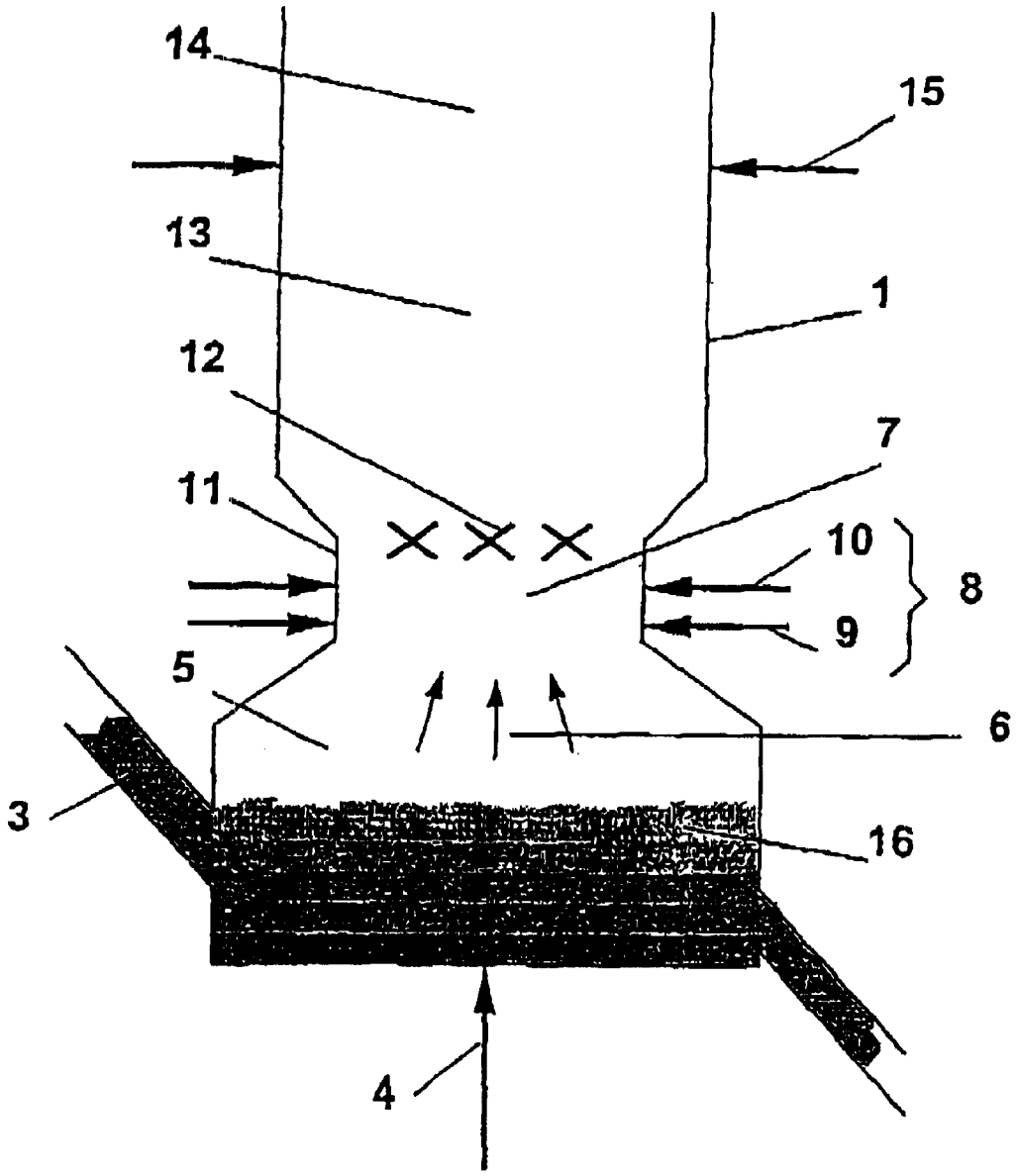
FIG. 2: shows a partial longitudinal section through an installation for the thermal treatment of waste in a second variant embodiment of the invention in which a fluidized bed is used as the first step.

FIG. 2 shows a further exemplary embodiment of the invention, which differs from the first exemplary embodiment only in that a fluidized bed 16 is used instead of the combustion grate in the first process step 5. The waste 3 is burnt under substoichiometric conditions in the fluidized bed 16, advantageously resulting in a very good mass and heat transfer and preventing local temperature peaks. As in the first exemplary embodiment, the gas 6 emerging from the fluidized bed 16 (first step 5) is mixed and homogenized in the subsequent mixing zone 7, into which a gaueous, virtually oxygen-free or low-oxygen medium 8, e.g. water steamn 9 recirculated flue gas 10, is introduced and, moreover, in which static installed components 12 are arranged which divert the flue gases 6 and therefore bring about intensive mixing and homogenization. The homogenized Co-rich flue gas emerging from the mixing zone 7 then passes into a holding zone 13, in which there is again a lack of oxygen. In the holding zone 13, some of the NO which has already been formed from the combustion is reduced in the presence of CO, $NH_1$ and HCN to form $N_2$. The flue gas then flows out of the holding zone 13 into the afterburning zone 14. There, an oxygen-containing medium 15, for example air, is added, in order to ensure complete burn-off of the flue gas.

Figure 3:
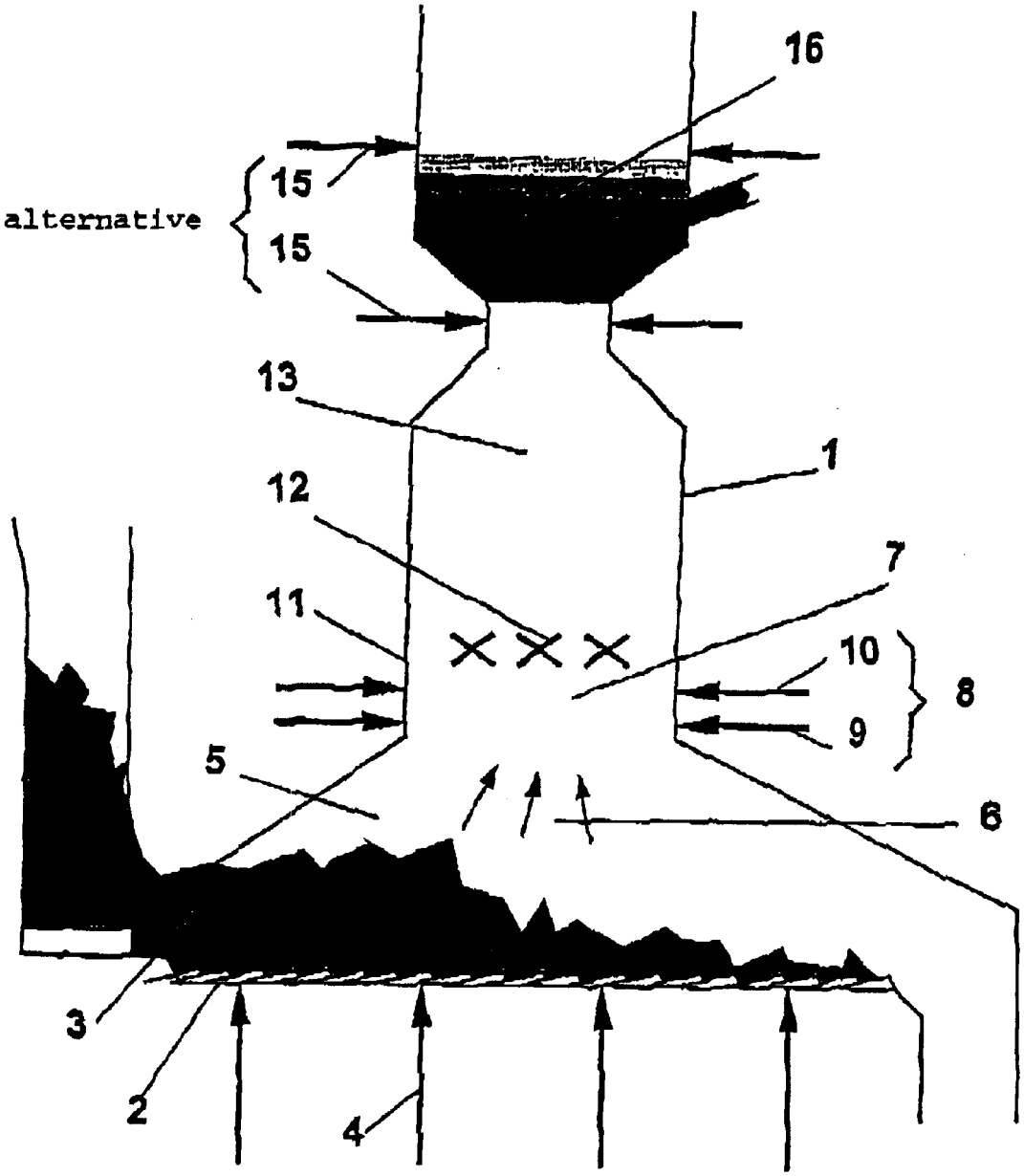
FIG. 3: shows a partial longitudinal section through an installation for the thermal treatment of waste in a third variant embodiment of the invention in which a combustion grate is used as the first step and a fluidized bed is used as the afterburning zone.

FIG. 3 shows an exemplary embodiment in which, in contrast to the example illustrated in FIG. 1, the afterburning zone 14 is designed as a fluidized bed 16. The oxygen-containing gaseous medium 15 is either introduced directly into the fluidized bed 16 or is introduced at the entry to the fluidized bed 16. Both these alternatives are illustrated in FIG. 3. By designing the afterburning zone 14 as a fluidized bed 16, it is possible, due to the high level of heat transfer caused by the presence of particles, to avoid local hot zones with high levels of thermal NOx formation. Moreover, it is possible to prevent caking on heat-exchanger walls and to considerably reduce the corrosion at heat-exchanger surfaces. It Is also possible to set higher steam pressures and temperatures, allowing higher thermal efficiency of the combustion installation to be achieved.

Figure 4:
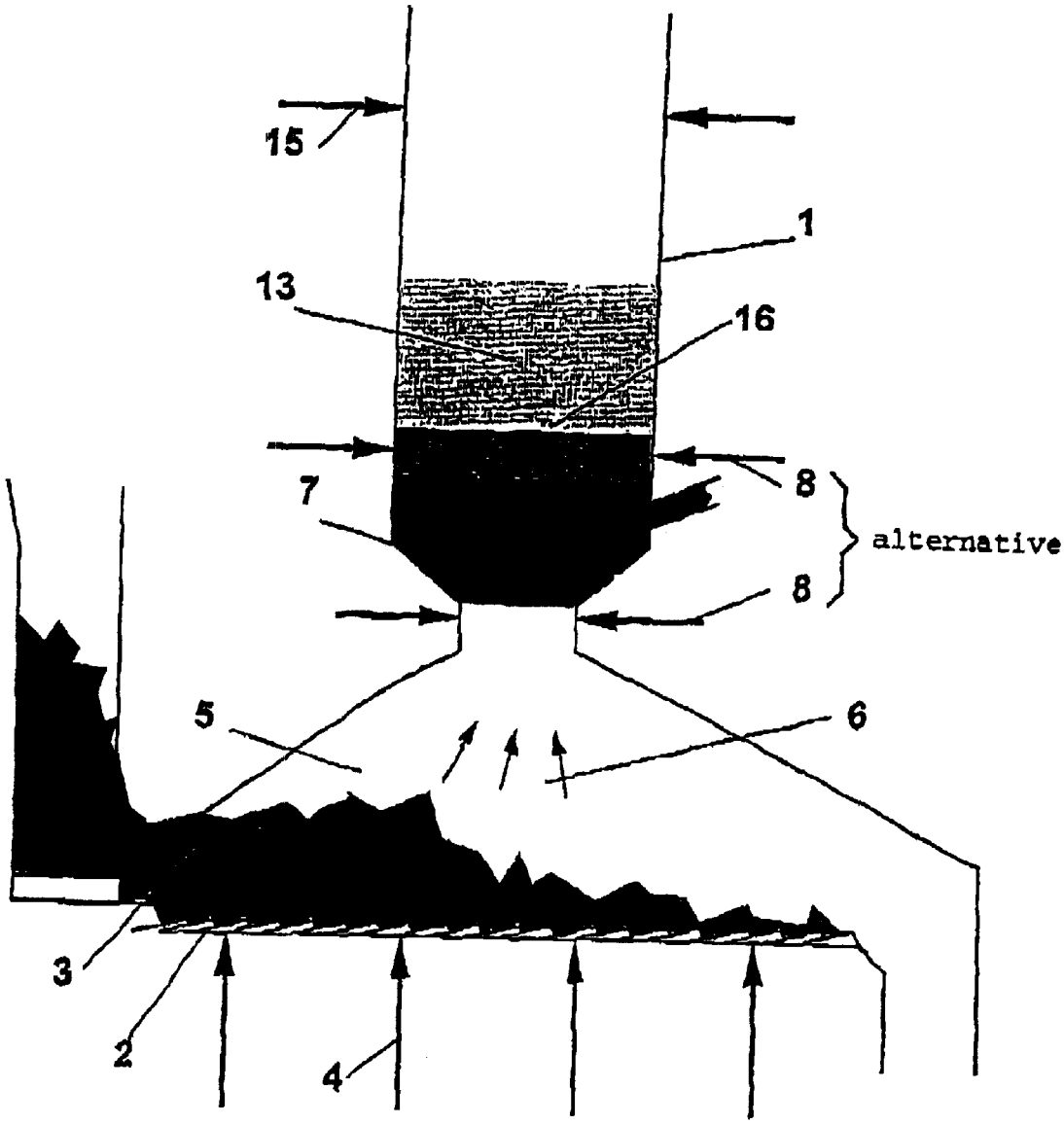
FIG. 4: shows a partial longitudinal section through an installation for the thermal treatment of waste in a fourth variant embodiment of the invention in which a combustion grate is used as the first step and a fluidized bed is used as the holding zone.

FIG. 4 shows a partial longitudinal section through an installation for the thermal treatment of waste in a fourth variant embodiment of the invention, in which a combustion grate 2 is used as the first step and a fluidized bad 16 is used as the holding zone 13. In contrast to FIG. 1, in this exemplary embodiment the mixing zone 7 is characterized by a widening in the cross section. Then, with the homogenized flue gas emerging from the mixing zone 7, intensive mass and heat transfer advantageously take place in the fluidized bed 16 (holding zone 13).

Figure 5:
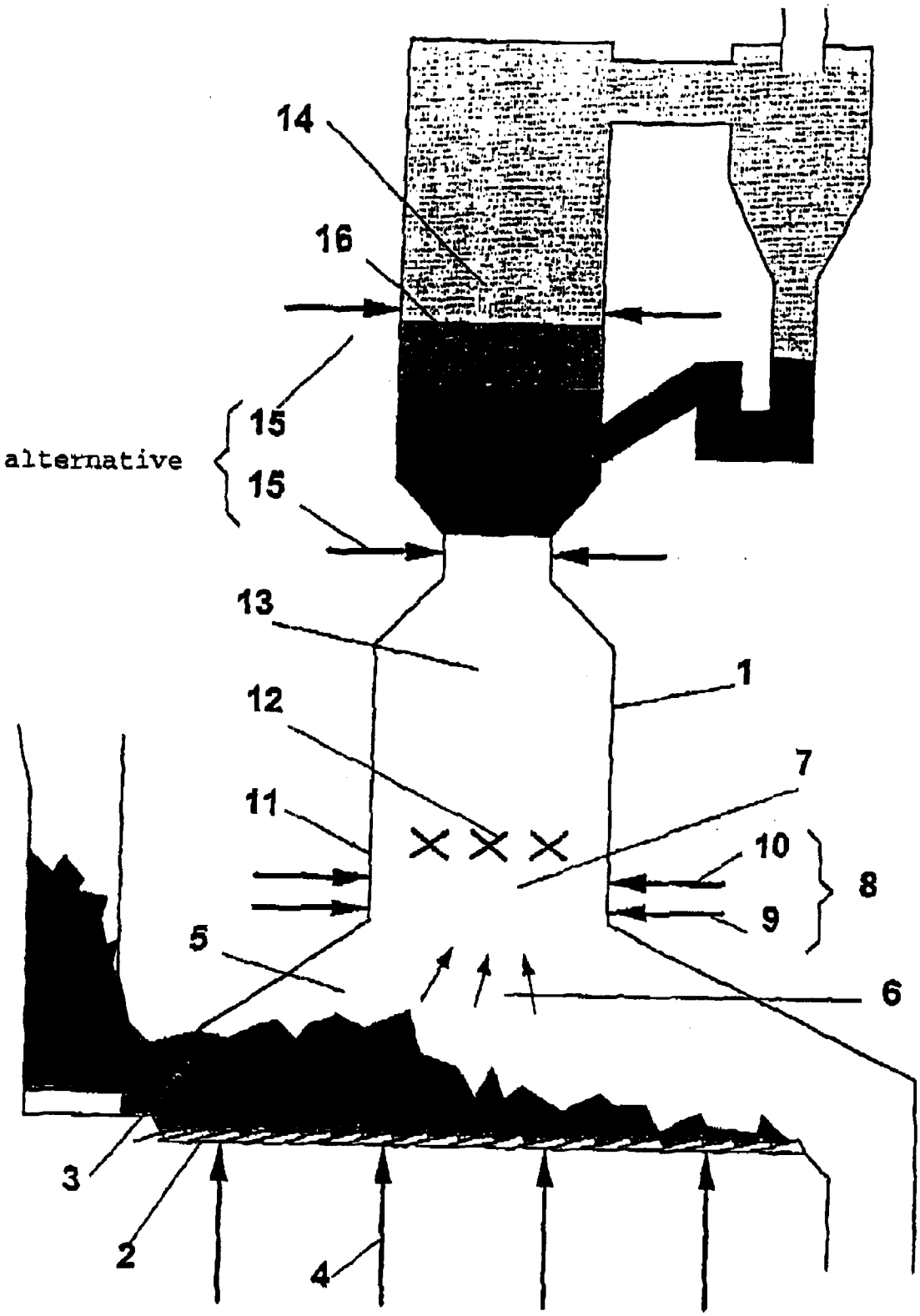
FIG. 5: shows a partial longitudinal section through an installation which is similar to that shown in FIG. 3 and in which a circulating fluidized bed forms the afterburning zone.

Finally, FIG. 5 shows a further variant embodiment, which differs from that shown in FIG. 3 only in that the fluidized bed 16 in the afterburning zone 14 is in this case a circulating fluidized bed, in which the empty pipe velocity in the riser is increased. The fluidized material is discharged into a cyclone and to then returned to the fluidized bed. The average vertical gas velocity in the riser is higher in the circulating fluidized bed than in the conventional fluidized bed, and the average relative velocity between gas and particles also increases. This leads to an increased heat and mass transfer between gas and particles and therefore to a reduced temperature and concentration distribution. In addition, by using an external fluidized-bed cooler, it is possible to vary the amount of heat withdrawn from the fluidized bed and thus to correctly set the fluidized-bed temperature and the temperature at the end of the afterburning zone.

Obviously, numerous modifications and variations of the present invention are possible in light of the above teachings. It is therefore to be understood that within the scope of the appended claims, the invention may be practiced otherwise than as specifically described herein. For example, in another exemplary embodiment, the holding zone 13 may also be designed as a circulating fluidized bed, or alternatively a grate system with countercurrent firing may be used.

While the present invention has been described by reference to the above-mentioned embodiments, certain modifications and variations will be evident to those of ordinary skill in the art. Therefore the present invention is to be limited only by the scope and spirit of the appended claims.

LIST OF DESIGNATIONS

1 Boiler
2 Grate
3 Solid material, for example waste
4 Primary air
5 First process step
6 Flue gas from pos. 5
7 Mixing zone
8 oxygen-free or low-oxygen gaseous medium
9 Water steam
10 Recirculated flue gas
11 Variations of cross-sectional area of the flow channel
12 Installed components/static mixing elements
13 Holding zone
14 Afterburning zone
15 Oxygen-containing gaseous medium
16 Fluidized bed

What is claimed:

1. A process for the thermal treatment of solid materials in which the solid materials are burnt/gasified or pyrolized in a first step with a lack of oxygen, and then, in an afterburning zone flue gases from the first step are mixed with an oxygen-containing gaseous medium and are burnt with complete burn-off, wherein, the flue gases emerging from the first step, before the flue gases are mixed with the oxygen-containing medium in a mixing zone, are actively homogenized with the addition of a gaseous, oxygen-free or low-oxygen medium into the mixing zone, and the homogenized, low-oxygen flue-gas stream emerging from the mixing zone, before the oxygen-containing medium which is required for complete burn-off is added, passes through a holding zone, the residence time in the holding zone being at least 0.5 second.

2. The process as claimed in claim 1, wherein the oxygen free or low oxygen used is recirculated flue gas.

3. The process as claimed in claim 1, wherein the oxygen free or low oxygen medium used is water steam.

4. The process as claimed in claim 1, wherein the oxygen free or low oxygen medium used is oxygen-depleted air.

5. The process as claimed in claim 1, wherein the oxygen free or low oxygen medium used is inert gas.

6. The process as claimed in claim 1, wherein the active homogenization of the flue gases emerging from the first step is carried out with the aid of components which are installed in the mixing zone.

7. The process as claimed in claim 6, wherein a cooling medium of water, steam or air, flows through the installed components.

8. The process as claimed in claim 1, wherein the active homogenization of the flue gases emerging from the first step is carried out by means of constriction or widenings of a cross section of a flow channel in the mixing zone.

9. The process as claimed in claim 1, wherein the temperature of the flue gases in an area where the oxygen-containing medium is injected is controlled by the amount of oxygen containing medium supplied to the mixing zone.

10. The process as claimed in claim 1, wherein in the holding zone the flue gases have a substoichiometric air ratio.

11. The process as claimed in claim 1, wherein a grate system with center-current grate firing is used in the first step.

12. The process as claimed in claim 1, wherein a grate system with countercurrent grate firing is used in the first step.

13. The process as claimed in claim 1, wherein a fluidized bed is used in the first step.

14. The process as claimed in claim 1, wherein the afterburning zone is a fluidized bed, and wherein the oxygen-containing gaseous medium is fed either to the flue gas when the oxygen containing gaseous medium enters the fluidized bed or directly into the fluidized bed.

15. The process as claimed in claim 1, wherein the holding zone includes a fluidized bed, and wherein the oxygen-free or low-oxygen gaseous medium is fed either to the flue gas when the oxygen free or low oxygen gaseous medium enters the fluidized bed or directly into the fluidized bed.

16. The process as claimed in claim 14, wherein the fluidized bed used is a circulating fluidized bed.

17. A method of thermally treating refuse comprising the steps of:

i) partially combusting the refuse with a lack of oxygen thereby producing CO, NO and low $O_2$-containing flue gasses;

ii) passing the flue gasses into a mixing zone and homogenizing the flue gasses by introducing at least one oxygen-free or low-oxygen medium into the mixing zone;

iii) passing the homogenized flue gasses into a holding zone comprising an oxygen-free or low-oxygen environment and reducing at least a portion of the NO contained in the homogenized flue gasses thereby forming $N_2$, wherein the homogenized flue gasses reside in the holding zone for at least 0.5 seconds;

iv) passing the reduced homogenized flue gasses into an afterburning zone; and v) adding an oxygen-containing medium in the afterburning zone thereby promoting complete burnoff of the reduced homogenized flue gasses.

* * * * *